US012258974B1

(12) United States Patent
Lee et al.

(10) Patent No.: US 12,258,974 B1
(45) Date of Patent: Mar. 25, 2025

(54) IMPELLER

(71) Applicant: GREEN TECH Co., Ltd, Gyeongsangbuk-do (KR)

(72) Inventors: Jung Gon Lee, Daegu (KR); Seung Min Lee, Daegu (KR); Min Seok Kwak, Daegu (KR); Nam Hoon Kim, Daegu (KR)

(73) Assignee: GREEN TECH Co., Ltd, Gyeongsangbuk-do (KR)

( * ) Notice: Subject to any disclaimer, the term of this patent is extended or adjusted under 35 U.S.C. 154(b) by 0 days.

(21) Appl. No.: 18/910,266

(22) Filed: Oct. 9, 2024

(51) Int. Cl.
*F04D 29/24* (2006.01)

(52) U.S. Cl.
CPC ..... *F04D 29/245* (2013.01); *F04D 29/242* (2013.01)

(58) Field of Classification Search
CPC ..... F04D 29/242; F04D 29/245; F04D 29/66
See application file for complete search history.

(56) References Cited

FOREIGN PATENT DOCUMENTS

| | | | |
|---|---|---|---|
| JP | 2015-135068 | A | 7/2015 |
| JP | 2015-178776 | A | 10/2015 |
| KR | 20-0229322 | Y1 | 7/2001 |
| KR | 10-2011-0106946 | A | 9/2011 |
| KR | 10-1347469 | B1 | 1/2014 |
| KR | 10-2228675 | B1 | 3/2021 |
| KR | 10-2428874 | B1 | 8/2022 |

*Primary Examiner* — Sabbir Hasan
(74) *Attorney, Agent, or Firm* — The PL Law Group, PLLC

(57) ABSTRACT

An impeller includes a hub, and a vain unit provided radially at a position spaced apart by a predetermined distance based on the hub. The vane unit is configured to begin at a position spaced apart by a predetermined radius based on the hub and to end to be formed into a streamlined shape in which a beginning portion becomes narrower in width than an end portion. The vane unit includes "n" first vanes radially configured at positions spaced apart by a radius r1 based on the hub and having a first length, where "n" is a natural number equal to or greater than 3; and "n" second vanes disposed between the first vanes, the second vanes having a second length that is less than the first length of the first vanes.

2 Claims, 6 Drawing Sheets

IMPELLER

CROSS REFERENCE TO RELATED APPLICATION AND CLAIM OF PRIORITY

This application claims the benefit under 35 USC § 119 of Korean Patent Application No. 10-2023-0153023 filed on Nov. 7, 2023, in the Korean Intellectual Property Office, the entire disclosure of which is incorporated herein by reference for all purposes.

BACKGROUND

1. Technical Field

The present invention relates to an impeller capable of reducing cavitation in a pump and improving suction force of the pump by way of the reduction.

2. Background Art

The content described below merely provides background information related to the present embodiment and does not constitute the prior art.

In general, a pump rotates an impeller to give a rotational force to water to pump it by centrifugal force, and includes the impeller with vanes formed thereon, a shaft that supports the impeller, and a motor that causes the shaft to rotate.

In the pump, a fluid first enters the central portion of the impeller through a suction fluid path and passes between the vanes, where the fluid is subjected to a rotational force to increase pressure, and then enters a casing as velocity energy is converted to pressure energy as it passes through the vanes. The casing collects the fluid from the impeller and discharges it to an outlet.

As described above, the pump draws in and lifts (or sucks) the fluid to transport it. In other words, the pump sucks and moves the fluid through the rotation of the impeller. The height or pressure at which the pump can move the fluid (hereafter referred to as 'suction force') is usually expressed in units of m (meters).

Thus, if the fluid is water, the pump cannot have a suction force greater than 10 meters under atmospheric pressure. In fact, it is not possible to suck the fluid with the suction force of 10 meters because part of the pressure will be consumed up by friction loss and velocity head in the suction pipes.

If the fluid is sucked more than 10 meters, cavitation may occur in the pump, which may cause various failures and shorten the life of the pump.

Cavitation refers to the formation of a cavity in a liquid by vaporization, which is a boiling phenomenon in which the local static pressure at the inlet of the pump impeller drops to the saturated vapor pressure of the liquid, resulting in the formation of many microscopic vapor bubbles.

In other words, when cavitation occurs due to low suction pressure, the bubbles will render the flow path of the impeller useless, reducing the efficiency and the total head of the pump, and eventually causing the total head of the pump to drop rapidly and become unable to pump.

In addition, the formation of the bubbles will cause noise and vibration in the pump, and if this condition persists, the impeller and the surface of the casing will be damaged by the shock pressure generated by the extinguishing of the bubbles.

SUMMARY

The present invention provides an impeller of a high suction type having a vane unit for sucking and discharging a fluid, which is capable of reducing the occurrence of cavitation in the impeller by forming the vane unit with vanes having a shape capable of enlarging the area of an inlet side so that the pressure drop just before the inlet of the impeller is reduced.

The problem to be solved by the present invention is not limited to the forgoing, and another problem to be solved will be clearly understood by those of ordinary skill in the art from the following descriptions.

In order to address the problems described above, according to an embodiment of the present invention, there is a provided an impeller in a pump configured to flow a fluid from an inlet to an outlet, the impeller may include: a hub; and a vain unit provided radially at a position spaced apart by a predetermined distance based on the hub to induce the suction of a fluid and discharge thereof, wherein the vane unit is configured to begin at a position spaced apart by a predetermined radius based on the hub and to end to be formed into a streamlined shape in which a beginning portion becomes narrower in width than an end portion in width from the beginning portion toward the end portion, and wherein the vane unit is configured to form an inlet side for sucking the fluid at a position adjacent to the hub and an outlet side for discharging the suctioned fluid. The vane unit may include: first vanes having a structure configured to increase the size of the inlet, the first vanes being radially configured at positions spaced apart by a radius r1 based on the hub and having "n" vanes of a first length, where "n" is a natural number equal to or greater than 3; and "n" second vanes disposed between the first vanes, the second vanes having a second length that is less than the first length and having a radius r2 that is greater than the radius r1 by a predetermined value.

According to an embodiment of the present invention, each of the n first and second vanes may include: a streamlined surface of a streamed shape formed such that a surface facing an inner side based on the hub supports the smooth flow of the fluid; and an inclined surface of an oblique shape formed such that a surface facing an outer side based on the hub provides a supporting force for the flow of the fluid.

According to an embodiment of the present invention, when the number of each of the first and second vanes is three, the second vanes may have a length that is 3-10% smaller than the first length of the first vanes.

According to an embodiment of the present invention, the first and second vanes may be formed on an inner side of front and rear shrouds disposed at both ends of the hub, respectively, and one or more back vanes formed to offset a pressure imbalance caused by a structural shape difference of the front and rear shrouds may be included on one or both of the front and rear shrouds.

According to an embodiment of the present invention, the first and second vanes may be formed on an inner side of the rear shroud disposed at a rear side of the hub, and the rear shroud may further include one or more back vanes formed on the outer side as many times as determined in consideration of the number and length, thickness, weight, and material of the first and second vanes.

According to an embodiment of the present invention, the back vanes may be formed on each of the front and rear shrouds, and may include a chamfer that assists in smoothly dispersing the pressure on the fluid while minimizing friction with the fluid.

According to the technical solution of the present invention described above, in the impeller having the vane unit for sucking and discharging the fluid, the vane unit is formed to have vanes with a shape capable of enlarging the area of the inlet so that the pressure drop just before the inlet of the impeller is reduced, thereby reducing the occurrence of the cavitation in the impeller.

DETAILED DESCRIPTION

Hereinafter, a specific embodiment of the present invention will be described with reference to the drawings. The following detailed description is provided to aid in a comprehensive understanding of a method, device, and/or system of the present invention described herein. However, this is merely an example and the present invention is not limited thereto.

In describing the embodiment of the present invention, detailed description of known technologies related to the present invention may be omitted so as not to unnecessarily obscure the gist of the present invention. In addition, the terms to be described in the following may be defined in view of functions of the present invention, which may vary depending on the intention or practice of a user or an operator. Therefore, the definition should be made on the basis of the content of the entire specification. The terminology used in the detailed description is intended only to describe an embodiment of the present invention and should not be construed as limiting. Unless otherwise explicitly stated, the singular form of an expression includes the meaning of the plural form. In this description, expressions such as "including" or "comprising" are intended to refer to certain features, numbers, steps, operations, elements, some or combinations thereof, and should not be construed to exclude the existence or possibility of one or more other features, numbers, steps, operations, elements, some or combinations thereof, other than those described.

An impeller for improving a suction force is described below with reference to the accompanying drawings.

Figure 1:
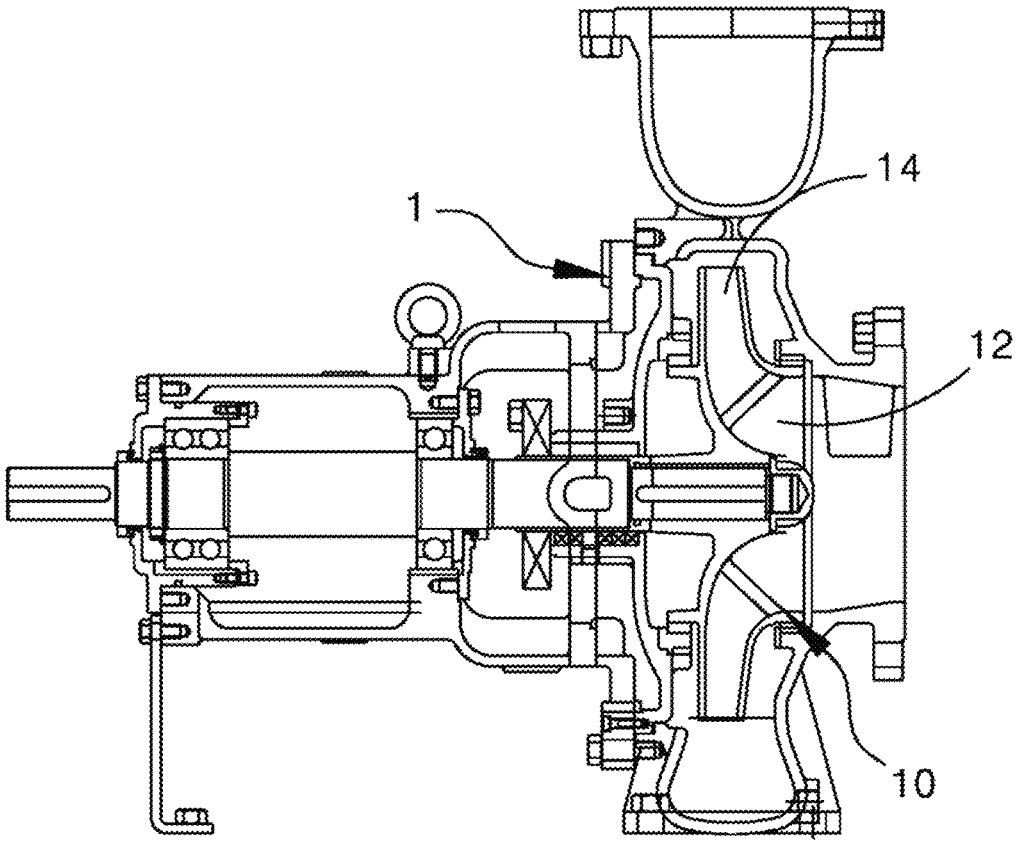
FIG. 1 is a schematic diagram of a pump according to an embodiment of the present invention.
Figure 2:
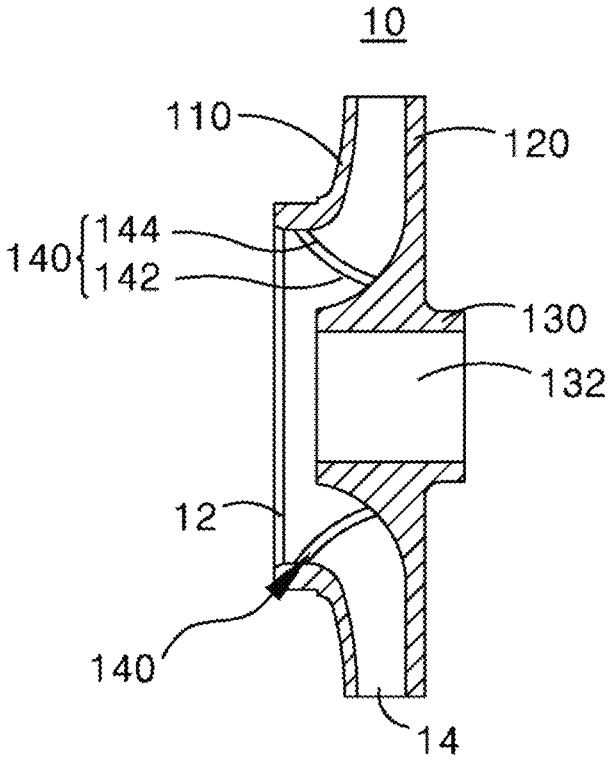
FIG. 2 is a cross-sectional view of an impeller according to an embodiment of the present invention.
Figure 3:
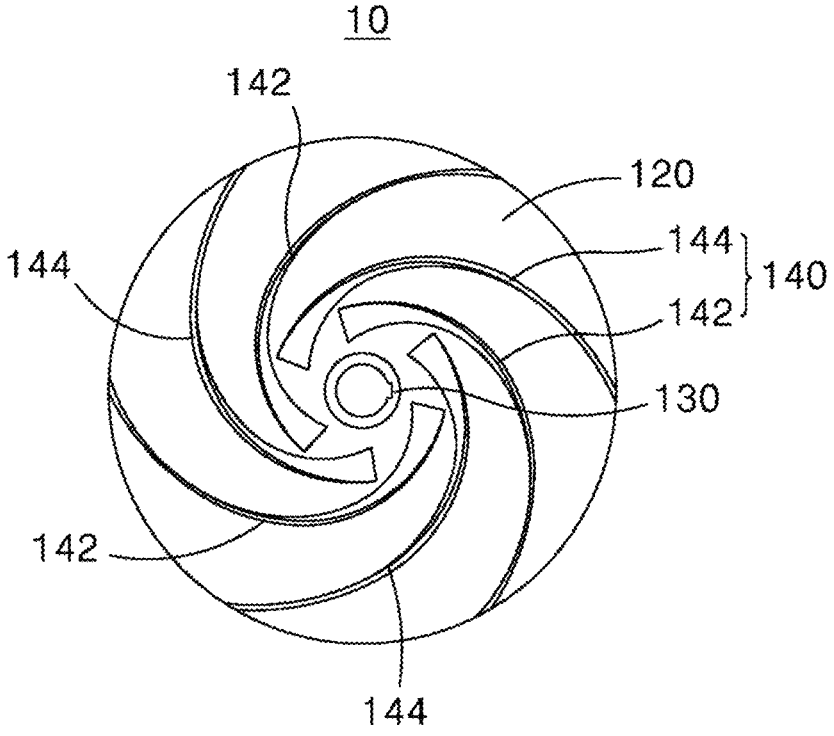
FIG. 3 is a side view of the impeller according to an embodiment of the present invention.
Figure 4:
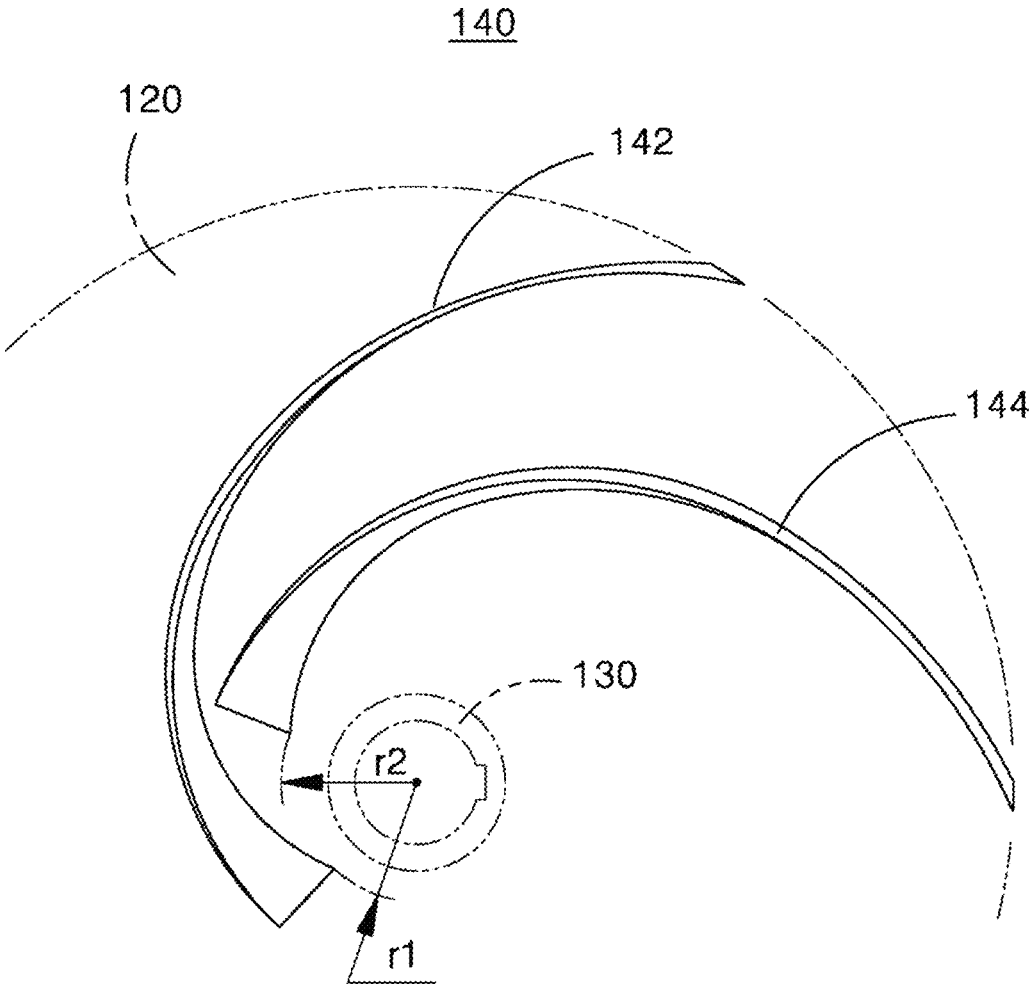
FIG. 4 is an enlarged view of a vane unit of the impeller according to an embodiment of the present invention.
Figure 5:
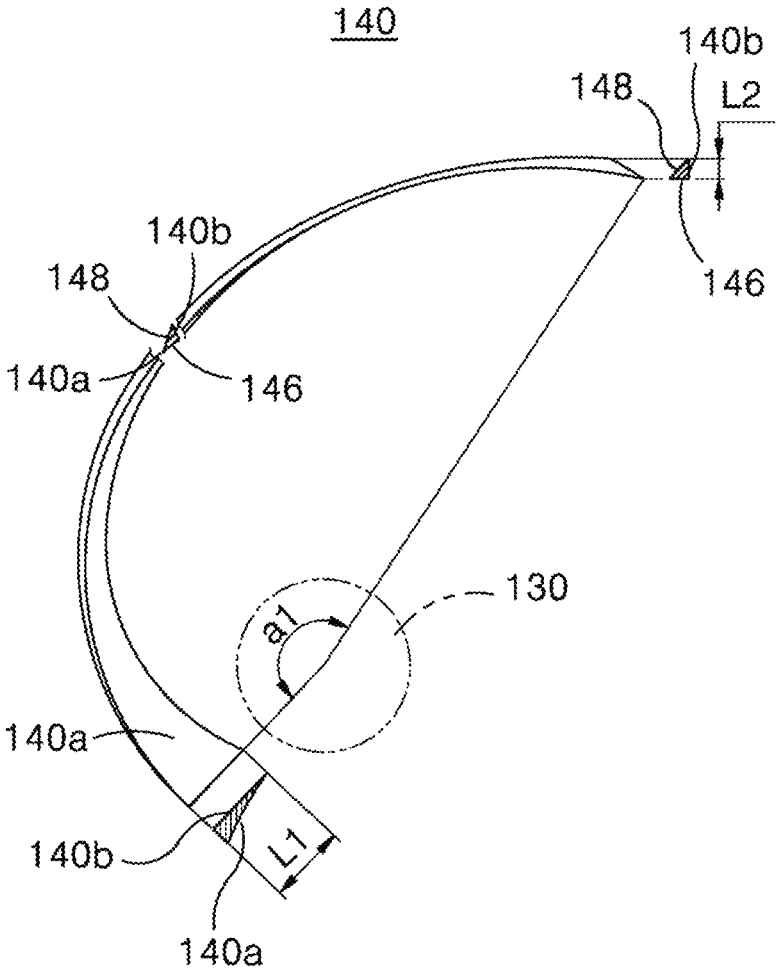
FIG. 5 is a diagram illustrating positions where first and second vanes in the vane unit are formed according to an embodiment of the present invention.
Figure 6:
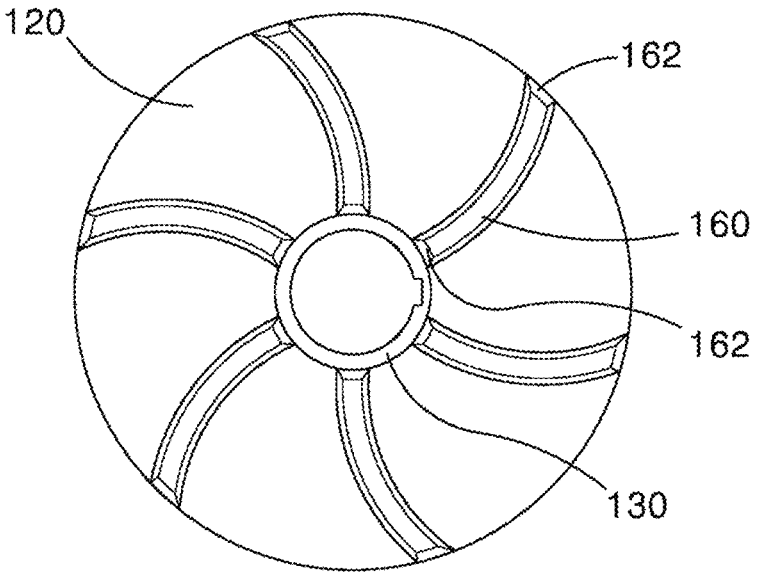
FIG. 6 is a side view of the impeller showing the configuration of a back vane according to an embodiment of the present invention.
Figure 7:
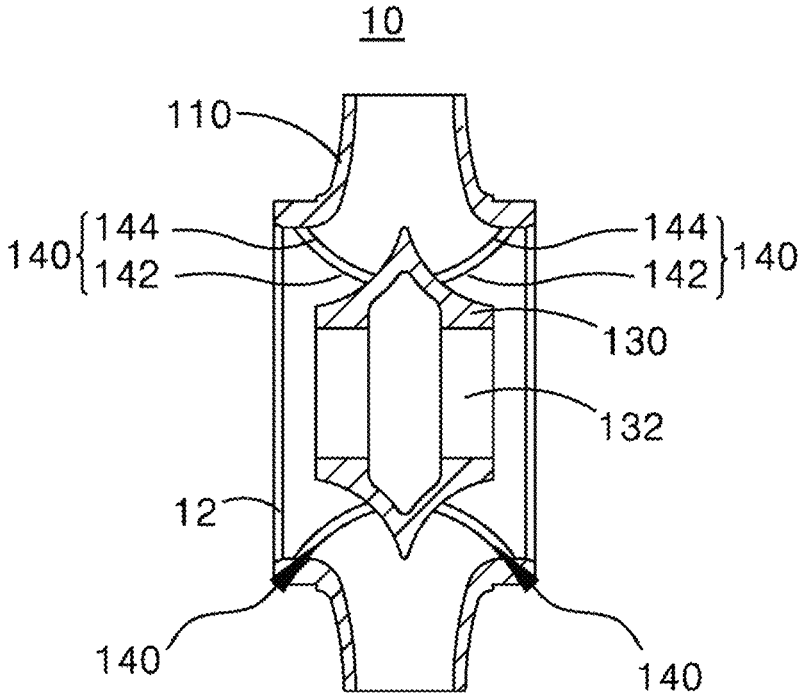
FIG. 7 is a diagram of a double suction pump to which the impeller of an embodiment of the present invention is employed.

FIG. 1 is a schematic diagram of a pump according to an embodiment of the present invention, FIG. 2 is a cross-sectional view of an impeller according to an embodiment of the present invention, FIG. 3 is a side view of the impeller according to an embodiment of the present invention, FIG. 4 is an enlarged view of a vane unit of the impeller according to an embodiment of the present invention, FIG. 5 is a diagram illustrating positions where first and second vanes in the vane unit are formed according to an embodiment of the present invention, FIG. 6 is a side view of the impeller showing the configuration of a back vane according to an embodiment of the present invention, and FIG. 7 is a diagram of a double suction pump to which the impeller of an embodiment of the present invention is employed.

As shown in FIGS. 1 to 5, a pump 1 according to an embodiment of the present invention rotates an impeller 10 to give a rotational force to water and pump it by centrifugal force, and may include, for example, but is not limited to, a single suction pump, a double suction pump, a volute pump, a turbine pump, or the like.

The impeller 10 according to an embodiment of the present invention may be mounted on a pump 1 and forcibly discharge a fluid from an inlet 12 to an outlet 14 by centrifugal force generated by its rotation. Specifically, the impeller 10 may include front and rear shrouds 110 and 120 configured at respective ends thereof, a hub 130 provided at a central portion of the front and rear shrouds 110 and 120 to support the front and rear shrouds 110 and 120, and a vane unit 140 disposed between the front and rear shrouds 110 and 120 to allow suction and discharge of the fluid by centrifugal force due to its rotation.

The front and rear shrouds 110 and 120 may include one or more back vanes 160 formed on one or both of the front and rear shrouds 110 and 120 to reduce the shaft thrust by minimizing the difference in pressure acting on each of the front and rear shrouds 110 and 120. That is, when the impeller 10 is of a closed type (having both the front and rear shrouds), the back vanes 160 may be formed on both or only one of the front and rear shrouds 110 and 120, and when the impeller 10 is of an open type (having only the rear shroud), the back vanes 160 may be formed only on the rear shroud 120.

The front shroud 110 may be configured to have a certain area at one end of, e.g., at a front side of the hub 130.

The rear shroud 120 may be configured to have a certain area at the other end of, e.g., at a rear side of the hub 130.

In the case where the front and rear shrouds 110 and 120 are configured to have a certain area at the respective ends of the hub 130 (e.g., in the case of a closed type impeller), a flow path is formed in the space between the front and rear shrouds 110 and 120 in the impeller so that the fluid can be sucked in and discharged. In other words, in the impeller 10, the inlet 12 is formed between the front and rear shrouds 110 and 120 at a location corresponding to the front side of the hub 130, and the outlet 14 is formed between the front and rear shrouds 110 and 120 at a location corresponding to the rear side of the hub 130. In addition, the flow path formed between the front and rear shrouds 110 and 120 is streamlined to guide a smooth flow of the fluid from the inlet 12 to the outlet 14. In this case, the front shroud 110 may be formed in a streamlined shape to minimize damage from friction with the fluid during high-speed rotation of the impeller 10, since it has a feature disposed on the front side of the hub 130, and the rear shroud 120 may be formed to have a structure for maintaining a seal with a motor provided on one side of the pump, since it has a feature disposed on the rear side of the hub 130.

The hub 130 is centrally provided to support the front and rear shrouds 110 and 120 and also to support the high speed rotation of the impeller 10 by maintaining a connection with the motor disposed in the pump 1. The hub 130 may include an insertion hole 132 into which a motor shaft extending from the motor is inserted and secured to support the motor.

In the pump 1 having a structure as described above, the impeller 10 may be provided with the vane unit 140 having a structure for enlarging the size of the inlet 12, the portion into which fluid is introduced, to improve the suction capability. Specifically, the vane unit 140 of the impeller 10 may include "n" first vanes 142 (where "n" is a natural number greater than or equal to 3), the ends of which begin at a position of a first radius r1 based on a center of the hub 130, and "n" second vanes 144 disposed between the first vanes 142, the ends of which begin at a position of a second radius r2 that is greater than the first radius r1.

In addition, the second vanes 144 may be disposed between the first vanes 142 and may be disposed radially in a plurality about the hub 130. For example, the first vanes 142 may be composed of three vanes, and the second vanes 144 may be composed of three vanes. Of course, the present invention is not limited thereto, and the first and second vanes 142 and 144 may vary in number depending on the purpose of their installation, the installation environment, or the efficiency of the lift head.

The first vanes 142 may be formed to begin at a location spaced apart by the first radius r1 based on the center point of the hub 130 and end at an outer periphery of the rear shroud 120, and the second vanes 144 may be formed to begin at a location spaced apart by the second radius r2 based on the center point of the hub 130 and end at the outer periphery of the rear shroud 120. In this case, the first and second vanes 142 and 144 are formed in a streamlined shape, such as an involute curve, to allow the fluid to flow smoothly from the inlet 12 to the outlet 14, wherein the second radius r2 may have a value greater than the first radius r1. Therefore, the first vanes 142 may be formed to be longer than the second vanes 144 by a value equal to the difference between the first and second radii r1 and r2, thereby increasing the size of the inlet 12.

Further, a width formed by beginning portions of the first and second vanes 142 and 144 located on the inlet 12 side is referred to as an initial width L1 and a width formed by end portions of the first and second vanes 142 and 144 located on the outlet 14 side is referred to as a final width L2, wherein the initial width L1 and the final width L2 may be formed in a length ratio of 1:0.3 to 0.6. Here, the initial width is greater than the final width to minimize damage caused by impact with the fluid being sucked by centrifugal force. In this regard, when the final width L2 is less than or equal to a length ratio of 0.3, the end portions of the first and second vanes 142 and 144 may be easily damaged by the fluid subjected to centrifugal force, and when the final width L2 is above a length ratio of 0.6, the rotational efficiency may be reduced by an increased weight.

In addition, the first and second vanes 142 and 144 may be formed to have an obtuse formation angle a1 between their beginnings and ends based on the center of the hub 130. Here, the formation angle a1 of the first and second vanes 142 and 144 may be about 160° to 175°.

Meanwhile, the vane unit 140 including the first and second vanes 142 and 144 may be formed on an impeller 10 of a closed type provided with the front shroud 110 and the rear shroud 120. In this case, the vane unit 140 has a first contact surface 140*a* that closely adhering to a surface of the front shroud 110 and a second contact surface 140*b* closely adhering to a surface of the rear shroud 120, wherein the first contact surface 140*a* becomes narrower in width relative to the second contact surface 140*b* as it progresses from the beginning toward the end.

In contrast, when the vane unit 140 may be formed on an impeller 10 of an open type, i.e., when it may be formed on the impeller 10 provided only with the rear shroud 120, only the second contact surface 140*b* may be closely adhered to the rear shroud 120 to form the vane unit 140.

Meanwhile, the cross-section of the vane unit 140 having the first and second vanes 142 and 144 in the impeller 10 described above may be formed to have a streamlined surface 146 which faces the inner side based on the hub 130 and which supports the smooth guidance of the fluid from the initial width L1 to the final width L2 of the vane unit 140 and provides the dispersion of the impact with the fluid, and an inclined surface 148 having an oblique shape, which faces the outer side based on the hub 130 and which supports its cross-sectional thickness and allows the fluid to be distributed for the smooth flow of the fluid.

By using the vane unit 140 having such a structure, the size of the inlet 12 side through which the fluid is drawn may be enlarged, thereby reducing the required net positive suction head (NPSHr) from the net positive suction head (NPSHa), as will be described in more detail below.

The first and second vanes 142 and 144 may be formed to have different lengths due to the difference in the locations where the first and second vanes 142 and 144 are formed. Specifically, in the case where the number of each of the first and second vanes 142 and 144 is three, it may be desirable to adjust their formation positions such that the second vanes 144 have a length (hereinafter referred to as a "second length") that is 3-10% smaller than a length of the first vanes 142 (hereinafter referred to as a "first length").

In other words, when the first vanes 142 are formed at a position of the first radius r1 based on the center point of the hub 130, which is the formation position of the first vanes, it may be desirable to form the second vane 144 at a position having a length that is 3-10% smaller than the first length, i.e., at a position of the second radius r2 based on the center point of the hub 130.

Meanwhile, the second length of the second vane 144 may be determined according to the condition that the required net positive suction head (HPSHr), which is the loss head generated by the pump 1 itself, satisfies Expression 2 below, by using the net positive suction head (HPSHa) as calculated by Equation 1 below based on an installation location of the pump 1 (altitude above sea level), atmospheric pressure (Pa), saturated vapor pressure (kgf/m2) (Pvp), specific weight (kgf/m3) (r), suction head (m) (Hz), loss head (m) (Hf) from the suction pipes connected to the pump 1, and the type and temperature of a conveying fluid.

$$\text{NPSHa}=P_{\alpha}/r+Hz-Hf-P_{v\alpha}/r \quad \text{[Equation 1]}$$

$$(\text{NPSHa}/(1+a))>\text{NPSHr} \quad \text{[Equation 2]}$$

In Equation 2, "a" may denotes an allowance rate.

Meanwhile, the back vanes 160 may be provided on the front shroud 110 or the rear shroud 120 to offset pressure difference caused by an area imbalance due to structural differences in the front and rear shrouds 110 and 120, thereby minimizing the shaft thrust and inhibiting vibration induction to improve the durability of the pump. For example, the back vanes 160 may be formed on the rear shroud 120.

In addition, the back vanes 160 may be formed to have a certain height on the rear shroud 120, and may be formed radially based on the hub 130.

In addition, the back vanes 160 may be formed in a streamlined shape to smoothly disperse the pressure acting on the shroud, as shown in FIG. 6.

In addition, the ends of the back vanes 160 may include a chamfer 162 that assists in smoothly dispersing the pressure on the fluid while minimizing friction with the fluid.

Accordingly, the back vanes 160 offsets the pressure imbalance caused by the difference in structural geometry of the front and rear shrouds 110 and 120 to reduce the shaft thrust. In addition, the back vanes 160, when formed on the rear shroud 120, may also have an unanticipated benefit of reducing the shaft thrust by directing the pressure acting on the rear surface of the rear shroud toward the outlet 14.

FIG. 7 shows an example in which the impeller 10 having the configuration as described above is applied to a double suction pump. In this case, the area of the inlet 12 of the double suction pump may be enlarged to improve the suction capability.

The foregoing description is merely an exemplary description of the technical ideas of the present invention, and various modifications and variations will be apparent to one skilled in the art to which the present invention belongs without departing from the essential features of the present invention. Therefore, the embodiments expressed in the invention are not intended to limit the technical idea of the invention but to illustrate it, and the scope of the invention is not limited by these embodiments. The scope of protection of the present invention should be construed on the basis of the following claims, and all technical ideas within the equivalent scope thereof should be construed as falling within the scope of the present invention.

What is claimed is:

1. An impeller in a pump configured to flow a fluid from an inlet to an outlet, the impeller comprising:

a hub; and a vane unit provided radially at a position spaced apart by a predetermined distance based on the hub to induce the suction of a fluid and discharge thereof, wherein the vane unit is configured to begin at a position spaced apart by a predetermined radius based on the hub and to end to be formed into a streamlined shape in which a beginning portion becomes narrower in width than an end portion from the beginning portion toward the end portion, and wherein the vane unit is configured to form an inlet side for sucking the fluid at a position adjacent to the hub and an outlet side for discharging the suctioned fluid, wherein the vane unit includes:

first vanes having a structure configured to increase the size of the inlet, the first vanes being radially configured at positions spaced apart by a radius r1 based on the hub and having "n" vanes of a first length, where "n" is a natural number equal to or greater than 3; and "n" second vanes disposed between the first vanes, the second vanes having a second length that is less than the first length and having a radius r2 that is greater than the radius r1 by a predetermined value, wherein each of the n first and second vanes includes:

a streamlined surface of a streamed shape formed such that a surface facing an inner side based on the hub supports the smooth flow of the fluid; and an inclined surface of an oblique shape formed such that a surface facing an outer side based on the hub provides a supporting force for the flow of the fluid, wherein the number of each of the first and second vanes is three, and the second vanes have a length that is 3-10% smaller than the first length of the first vanes, and an initial width L1 and a final width L2 of the first and second vanes are formed in a 1:0.3 to 0.6 length ratio, wherein the initial width L1 denotes a width formed by the beginning portion of the first and second vanes located on the inlet side and the final width L2 denotes a width formed by the end portion of the first and second vanes located on the outlet side.

2. The impeller according to claim 1, wherein the impeller is of a closed type having front and rear shrouds disposed at both ends of the hub, respectively, the vain unit being formed on the inside of the front and rear shrouds, and wherein the front or rear shroud has one or more back vanes configured to offset the pressure imbalance caused by a structural shape difference of the front and rear shrouds.

* * * * *